US010320085B1

(12) United States Patent
Lier et al.

(10) Patent No.: US 10,320,085 B1
(45) Date of Patent: Jun. 11, 2019

(54) HIGH EFFICIENCY SHORT BACKFIRE ANTENNA USING ANISOTROPIC IMPEDANCE WALLS

(71) Applicant: LOCKHEED MARTIN CORPORATION, Bethesda, MD (US)

(72) Inventors: Erik Lier, Newtown, PA (US); Matthew George Bray, Ellicott City, MD (US); Thomas Henry Hand, Littleton, CO (US); Bonnie Gean Martin, Lumberton, NJ (US)

(73) Assignee: Lockheed Martin Corporation, Bethesda, MD (US)

( * ) Notice: Subject to any disclaimer, the term of this patent is extended or adjusted under 35 U.S.C. 154(b) by 225 days.

(21) Appl. No.: 14/715,500

(22) Filed: May 18, 2015

Related U.S. Application Data

(60) Provisional application No. 62/009,098, filed on Jun. 6, 2014.

(51) Int. Cl.

| | |
|---|---|
| ***H01Q 15/24*** | (2006.01) |
| ***H01Q 19/10*** | (2006.01) |
| ***H01Q 21/06*** | (2006.01) |

(52) U.S. Cl.
CPC ..... *H01Q 19/10* (2013.01); *H01Q 15/244* (2013.01); *H01Q 21/06* (2013.01)

(58) Field of Classification Search
CPC ..... H01Q 19/10; H01Q 21/06
See application file for complete search history.

(56) References Cited

U.S. PATENT DOCUMENTS 4,051,474 A * 9/1977 Mack ..... H01Q 21/245 342/362
2010/0078203 A1* 4/2010 Lier ..... H01Q 13/02 174/258

OTHER PUBLICATIONS

G. S. Kirov, "Design of short backfire antennas [antenna designer's notebook]," IEEE Antennas Propag. Mag., vol. 51, No. 6, pp. 110-120, Dec. 2009.*

(Continued)

*Primary Examiner* — Jessica Han
*Assistant Examiner* — Amal Patel
(74) *Attorney, Agent, or Firm* — Morgan, Lewis & Bockius LLP

(57) ABSTRACT

A high efficiency short backfire antenna (SBFA) includes a cylindrical reflector and a feed structure. The conductive cylindrical reflector is configured to collect or to radiate electromagnetic waves. The cylindrical reflector has a reflector base and a reflector wall. The feed structure is electromagnetically coupled to the cylindrical reflector. The reflector wall includes a dielectric liner formed on an inside surface of the cylindrical reflector, and the dielectric liner is covered with a structured anisotropic impedance surface.

19 Claims, 15 Drawing Sheets

(56) References Cited

OTHER PUBLICATIONS

A. Andersson, P. Bengtsson, A. Molker and A. Roederer, "Short backfire antenna arrays for space communications," 1977 Antennas and Propagation Society International Symposium, Stanford, CA, USA, 1977, pp. 194-197.*

Hermann W. Ehrenspeck, John A. Strom, "The Short-Backfire Antenna as an Element for High-Gain Arrays", Apr. 13, 1977, Air Force Cambridge Research Laboratories, Microwave Physics Laboratory, Physical Sciences Research Papers, No. 451, Bedford, Massachusetts.*

J. A. Nessel, C. L. Kory, K. M. Lambert, R. J. Acosta and F. A. Miranda, "A microstrip patch-fed short backfire antenna for the tracking and data relay satellite system-continuation (TDRSS-C) multiple access (MA) array," 2006 IEEE Antennas and Propagation Society International Symposium, Albuquerque, NM, 2006, pp. 521-524.*

* cited by examiner

HIGH EFFICIENCY SHORT BACKFIRE ANTENNA USING ANISOTROPIC IMPEDANCE WALLS

CROSS-REFERENCE TO RELATED APPLICATIONS

This application claims the benefit of priority under 35 U.S.C. § 119 from U.S. Provisional Patent Application 62/009,098 filed Jun. 6, 2014, which is incorporated herein by reference in its entirety.

STATEMENT REGARDING FEDERALLY SPONSORED RESEARCH OR DEVELOPMENT

Not applicable

FIELD OF THE INVENTION

The present invention generally relates to antennas, and more particularly, to a high efficiency short backfire antenna using anisotropic impedance walls or electromagnetically hard walls.

BACKGROUND

Short backfire antennas (SBFAs) have seen wide use in terrestrial, maritime, and space-based applications due to their high directivity and low profile. Compared to endfire elements such as the Yagi and Helix antennas, the height of the SBFA is approximately ⅛ of Yagi and ⅕ of Helix antennas for the same directivity (e.g., about 15 dBi). One of the simplest and most widely used variations of the SBFA includes a shallow half-cylinder reflector with a 2λ diameter and a 0.25λ high rim. This SBFA is fed by a dipole placed 0.2λ above the center of the back wall of the reflector, and has a 0.4λ sub-reflector placed 0.25λ above the dipole. The polarization can be linear or circular. The measured antenna efficiency of this SBFA is approximately 83.9% (15.2 dBi). One variation of this basic configuration replaces the flat main reflector disc with conical profile, and also adds a small parasitic sub-reflector. This type of antenna has similar efficiency to the above-described SBFA with shallow half-cylinder reflector but with a wider bandwidth.

Another variation is an archery target antenna that uses an annular ring around the sub-reflector, allowing the antenna to use a much larger 5λ main reflector at the expense of approximately 46% aperture efficiency. An additional variation employs annular corrugated soft surface walls to improve the directivity over a baseline configuration with straight metal walls. However, both versions exhibited relatively low aperture efficiency.

For SBFAs, linear polarization (LP) can be generated by a linearly polarized feed such as a dipole or LP microstrip patch antenna, and circular polarization (CP) may be generated by a circularly polarized feed such as a crossed dipole fed via 90° hybrid, a CP microstrip patch antenna, or a spiral feed. The circular polarization can also be generated by a linearly polarized feed with a planar (spatial) CP polarizer in the aperture such as a meander-line polarizer.

SUMMARY

In some aspects, a high efficiency short backfire antenna (SBFA) is described. The SBFA includes a cylindrical reflector and a feed structure. The cylindrical reflector is configured to collect or to radiate electromagnetic waves.

The cylindrical reflector has a reflector base and a reflector wall. The feed structure is electromagnetically coupled to the cylindrical reflector. The reflector wall includes a dielectric liner formed on an inside surface of the cylindrical reflector, and the dielectric liner is covered with a structured anisotropic impedance surface.

In other aspects, a method for providing a high efficiency short backfire antenna (SBFA) includes providing a cylindrical reflector and a feed structure. The cylindrical reflector is configured to collect or to radiate electromagnetic waves, and includes a reflector base and a reflector wall. The feed structure is electromagnetically coupled to the cylindrical reflector. The reflector wall includes an inside liner. The inside liner includes a dielectric material and includes an electromagnetically (EM) hard surface comprising longitudinal strips.

In yet other aspects, an antenna array includes a plurality of high efficiency short backfire antenna (SBFA) elements. Each SBFA includes a cylindrical reflector and a feed structure. The cylindrical reflector includes a reflector base and a reflector wall and is configured to collect or to radiate electromagnetic waves. The feed structure is electromagnetically coupled to the cylindrical reflector and is configured to convert collected electromagnetic waves to an induced electrical current or to convert a feed electrical current to electromagnetic waves for transmission by the SBFA. The reflector wall includes a dielectric liner formed on an inside surface of the cylindrical reflector, and the dielectric liner is covered with an anisotropic impedance boundary.

The foregoing has outlined rather broadly the features of the present disclosure in order that the detailed description that follows can be better understood. Additional features and advantages of the disclosure will be described hereinafter, which form the subject of the claims.

BRIEF DESCRIPTION OF THE DRAWINGS

For a more complete understanding of the present disclosure, and the advantages thereof, reference is now made to the following descriptions to be taken in conjunction with the accompanying drawings describing specific aspects of the disclosure, wherein.

DETAILED DESCRIPTION

The detailed description set forth below is intended as a description of various configurations of the subject technology and is not intended to represent the only configurations in which the subject technology can be practiced. The appended drawings are incorporated herein and constitute a part of the detailed description. The detailed description includes specific details for the purpose of providing a thorough understanding of the subject technology. However, it will be clear and apparent to those skilled in the art that the subject technology is not limited to the specific details set forth herein and can be practiced using one or more implementations. In one or more instances, well-known structures and components are shown in block diagram form in order to avoid obscuring the concepts of the subject technology.

The present disclosure is directed, in part, to methods and configuration for providing a high efficiency short backfire antenna (SBFA) using anisotropic impedance boundaries or electromagnetically (EM) hard walls. The subject technology increases the aperture efficiency of the SBFA by adding EM hard walls inside the walls of the reflector or cup. The addition of the hard EM walls enables close to uniform aperture field to be supported over the radiating aperture that corresponds to high aperture efficiency and high gain. A circular aperture with strip-loaded hard walls of the subject technology can achieve close to 100% aperture efficiency for a 2 wavelength (λ) aperture, as compared to ~84% for a conventional short backfire antenna. The hexagonal aperture SBFA elements, when used in array antennas, can offer 10% higher array aperture efficiency than arrays with circular antenna elements due to 100% packaging efficiency of the hexagonal aperture arrays.

The subject technology offers a number of advantageous features over the existing SBFAs. For example, an aperture efficiency of a circular short backfire antenna of the subject technology is nearly 0.7 dB higher than the state of-the-art SBFAs over a single frequency band, and about 1 dB in average over the L1 and L2 dual GPS band. With a hexagonal design, an additional 0.42 dB array aperture efficiency can be obtained due to 100% array packaging efficiency when used as an element in an array. Aperture efficiencies above 90% can be achieved with a strip loaded circular or hexagonal cavity walls or with a metamaterial wall liner. An additional advantage of the subject technology over existing SBFAs is low cross-polarization or axial ratio (AR) due to a more uniform aperture distribution with straighter field lines.

Figure 1:
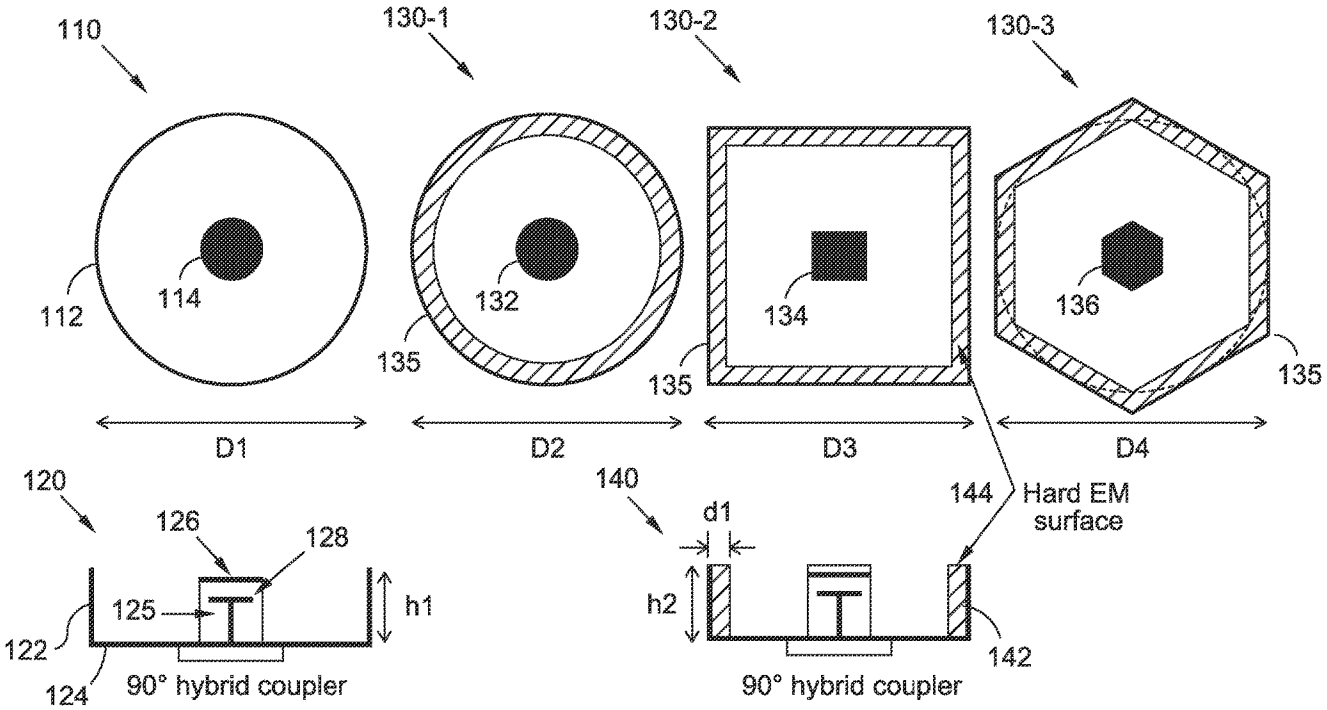
FIG. 1 is a conceptual diagram illustrating a top view and a cross sectional view of a conventional short backfire antenna (SBFA) and top views and a cross sectional views of example high efficiency SBFAs, according to certain aspects of the subject technology.

FIG. 1 is a conceptual diagram illustrating a top view 110 and a cross sectional view 120 of a conventional short backfire antenna (SBFA) and top views 130 and a cross sectional view 140 of example high efficiency SBFAs, according to certain aspects of the subject technology. A top view 110 of the conventional SBFA shows a cylindrical reflector 112 with a circular reflector base and a feed structure 114. When the SBFA is used as a receiver antenna, the reflector 112 collects the electromagnetic waves (e.g., a radio-frequency (RF) signal) and concentrates the collected electromagnetic waves onto the feed structure 114. The feed structure 114 converts the power of the collected electromagnetic waves into an electrical signal (e.g., a current) that is transmitted through a transmission line (e.g., a coaxial cable) to a receiver that amplifies and process the electrical signal. On the other hand, when the SBFA is used as a transmitter antenna, the feed structure 114 receives a signal from a transmitter and converts the signal into electromagnetic waves (e.g., an RF signal) that are radiated (transmitted) by the reflector 112. The cross sectional view 120 shows the reflector 112 having a reflector wall 122 and a reflector base 124 that can be made in a single piece from an electrically conductive material (e.g., a metal such as copper). An example implementation of a feed structure 114 is shown to include a reflector cup 126 and a dipole 128 which are embedded in a dielectric material 125 (e.g., foam) and are coupled through a 90° hybrid coupler (e.g., in the case circular polarization is being radiated) to a transmission line. In one or more implementations, the dielectric material 125 can be an artificial dielectric formed of, for example, a honeycomb structure (e.g., cardboard). For linearly polarized fields no 90° hybrid coupler is needed. A height h1 of the reflector wall 122 is within a typical range of 0.25-1.5λ where λ is the wavelength of the electromagnetic waves. A diameter D1 of the reflector base 124 is typically 2λ.

The high efficiency SBFA of the subject technology, as shown in top views 130 (130-1, 130-2, and 130-3) are distinct from the conventional SBFA by addition of a hard (e.g., electromagnetically (EM) hard) surface 144 on a wall of the reflector 135, or more generally an anisotropic impedance surface. The high efficiency SBFA can be made with a cylindrical reflector of any shape (e.g., shape of the reflector base). The top views 130-1, 130-2, and 130-3 show examples of circular, square, and hexagonal shape reflectors, but could be a multi-section shape where each side section includes a flat surface. In general, a circular aperture offers the highest aperture efficiency of the three configurations. The feed structures 132, 134, and 136 have reflector cups that have the shape of respective reflector bases of the cylindrical reflectors, although it could have circular shape for all three configurations. In some implementations, the feed structures 132, 134, and 136 can be similar to the feed structure of the conventional SBFA and be coupled through a 90° hybrid coupler to a transmission line in the case of circular polarization. In the high efficiency SBFA of the subject technology, the height h2 of the wall 142 of the cylindrical reflector 135 is within the typical range of 0.25-1.5λ, and is chosen in a performance optimization simulation, as discussed herein. An important performance metric of the SBFA is an aperture efficiency, which can be defined as the directivity of the antenna relative to the ideal directivity $D_i=4\pi A/\lambda^2$, where A is the aperture area. The subject technology optimizes SBFA design parameters such as the height h2 of the reflector wall 142, the thickness d of the EM hard surface 144, the anisotropic wall impedance (or wall metal structure), and the feed position and feed parameters to achieve an optimum aperture efficiency, assuming a diameter (e.g., D2, D3, and D4) of the reflector base (e.g., within the typical range of 1.8-2.2λ). It is understood that the antenna aperture efficiency ($\eta_{ap}$) is related to the antenna gain (G) by the electrical efficiency including insertion loss and return loss ($\eta_E$) of the antenna, which is below 1 for a passive antenna. For example, the antenna gain can be written as: $G=D_i*\eta_E*\eta_{ap}$, where * denotes multiplication.

Figure 2:
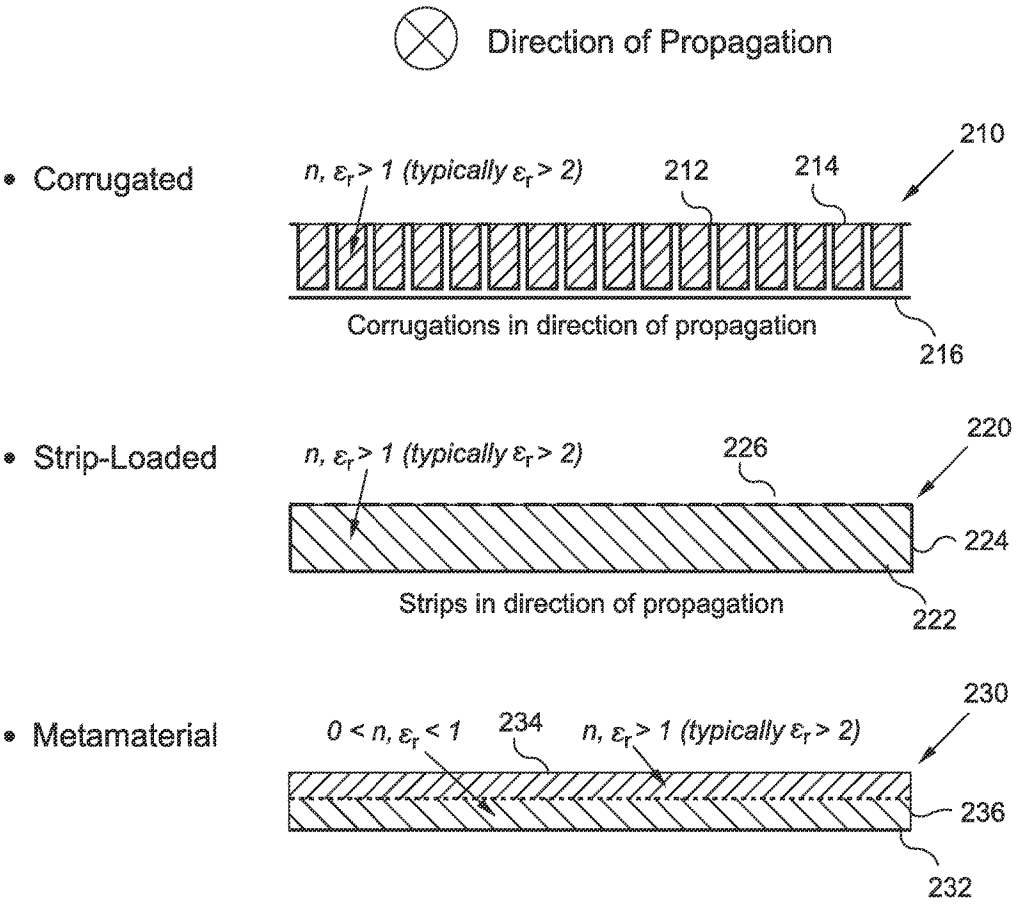
FIG. 2 is a diagram illustrating examples of hard surfaces of a SBFA, according to certain aspects.

FIG. 2 is a diagram illustrating examples of hard surfaces 210, 220, and 230, according to certain aspects of the subject technology. The EM hard surface 144 of FIG. 1 can be implemented in a number of ways. For example, the EM hard surface 210 is a corrugated hard surface formed by filling grooves 214 of a corrugated metal 212 with a dielectric material, for example, with a permittivity $\varepsilon_r>2$ (e.g., alumina). The corrugation of the EM hard surface 210 is formed in the direction of propagation of the electromagnetic waves. The corrugated metal 214 covers the reflector wall 216.

In some embodiments, the EM hard surface can be a strip-loaded surface 220 formed by creating a dielectric layer 224 on a metal surface 222 (e.g., the reflector wall 142 of FIG. 1) and forming strips 226 on the dielectric layer 224. In some aspects, the strips 226 are formed of an electrically conductive material such as a metal (e.g., copper, aluminum, etc.). The strips 226 are formed in the direction of propagation of the electromagnetic waves.

Another example implementation of the EM hard surface 144 of FIG. 1 is the EM hard surface 230 created by forming a metamaterial including, for example, two layers 234 and 236 of materials with different permittivity (e.g., $\varepsilon_r>2$ and $\varepsilon_r<1$, respectively) on a metal surface 232 (e.g., the reflector wall 142). More detailed analysis of the strip-loaded EM hard surface 220 will be presented herein.

Figure 3B:
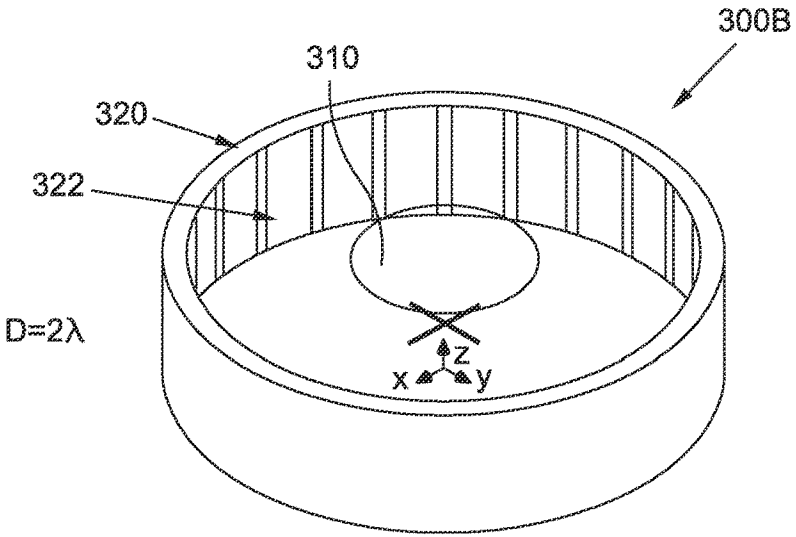
FIGS. 3A through 3D are diagrams illustrating examples of SBFAs and corresponding simulated performance results, according to certain aspects.
Figure 3A:
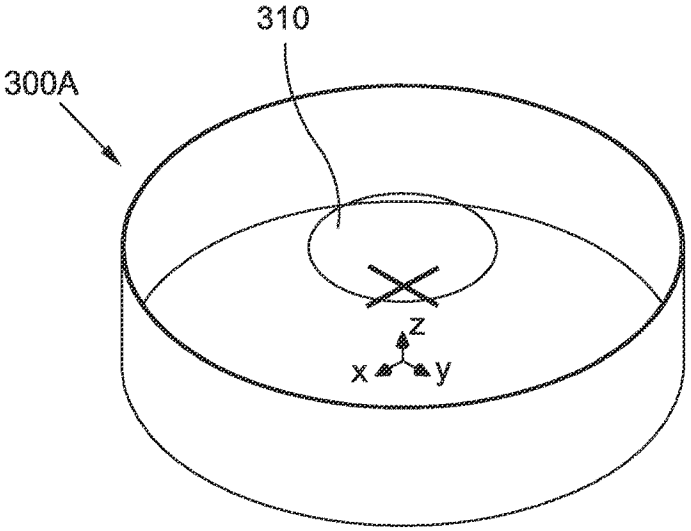
Figure 3C:
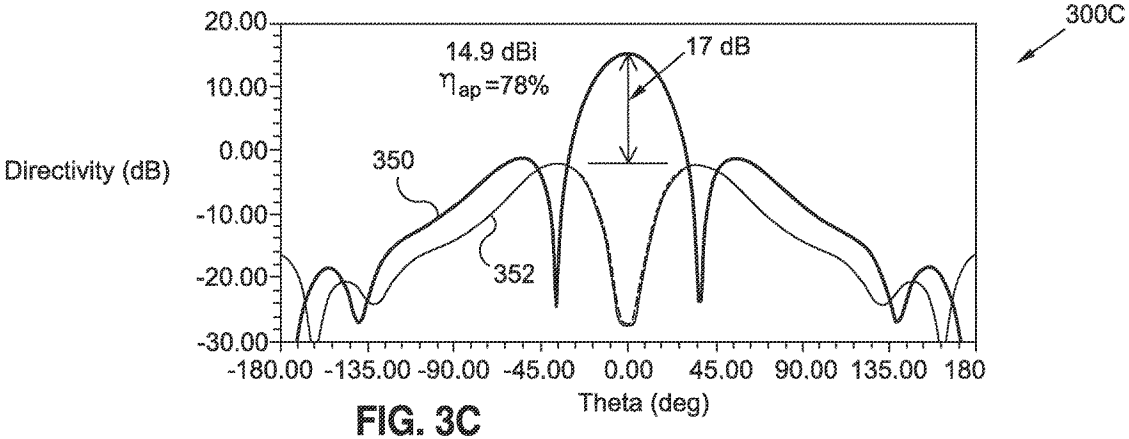
Figure 3D:
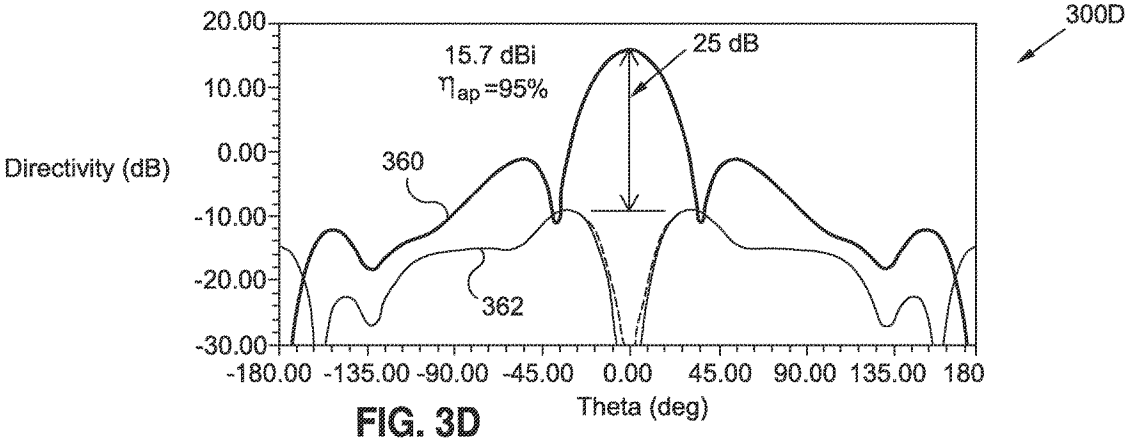

FIGS. 3A through 3D are diagrams illustrating examples of SBFAs 300A and 300B and corresponding simulated performance results 300C and 300D, according to certain aspects of the subject technology. The SBFA 300A, shown in FIG. 3A, is similar to the conventional SPFA 110 of FIG. 1 and has a crossed-dipole feed structure 310. The SBFA 300B, shown in FIG. 3B, is a high efficiency SPFA similar to the SPFA 130-1 of FIG. 1, except that in FIG. 3B, for simplicity, only a dielectric layer 320, metal strips 322, and the crossed-dipole feed structure 310 are shown. The simulated performance results 300C of FIG. 3C shows plot 350 and 352 of co-polarization pattern and cross-polarization pattern, respectively, for the SBFA 300A. The simulated performance results 300D of FIG. 3D shows plot 360 and 362 of co-polarization pattern and cross-polarization pattern, respectively, for the SBFA 300B. The high efficiency SBFA of FIG. 3B is seen to offer considerably higher (~0.7 dB) directivity and lower peak cross-polarization relative to peak co-polarization (25 dB versus 17 dB) as compared to the conventional SBFA of FIG. 3A. Further, the aperture efficiency $\eta_{ap}$ is seen to have been improved by ~17 percent, and relative peak cross-polarization by 8 dB.

Figure 4B:
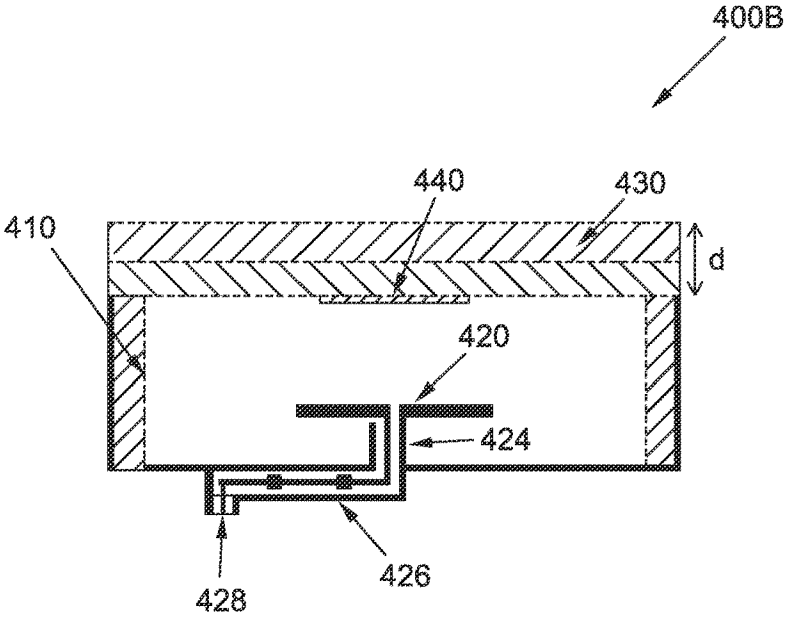
FIGS. 4A through 4E are diagrams illustrating examples of SBFAs with different feed structures, according to certain aspects.
Figure 4A:
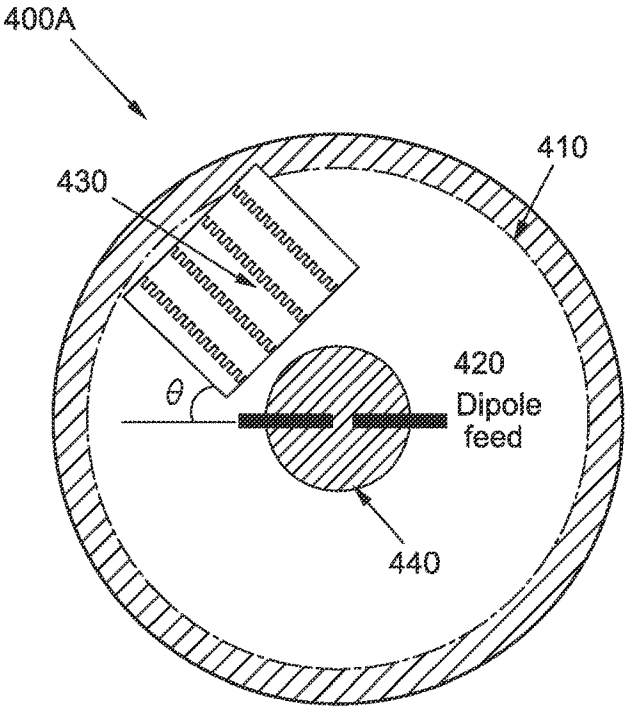

FIGS. 4A through 4E are diagrams illustrating examples of SBFAs with different feed structures, according to certain aspects of the subject technology. The SPFA shown in the top view 400A of FIG. 4A and the cross-sectional view 400B of FIG. 4B is a circular cylindrical SBFA that uses a dipole feed structure. The dipole feed structure includes dipole elements 420, which are coupled through a coaxial balun 424, a matching network element 426 (e.g., a TEM-line $\lambda/4$ stub) for high power handling, and a coax connector 428 to a transmission line. The SPFA shown on the top view 400A is a high efficiency SPFA that uses a hard EM surface 410 implemented as metal features on a dielectric liner with a dielectric constant of, for example, 1.7, but is not limited to this value. It further includes a circular sub-reflector 440 and planar (e.g., meander-line) polarizer 430 that converts the field between linear and circular polarization. The meander-line polarizer 430 offers a desirable RF performance, offering relative cross-polarization within the GPS field-of-view (~±14°) below −30 dB, and provides support and ESD bleed-off path for the sub-reflector 440. The meander-line polarizer and dipole feed concept offers an alternative antenna implementation for circularly polarized fields compared to a circularly polarized feed and a 90° hybrid.

Figure 4D:
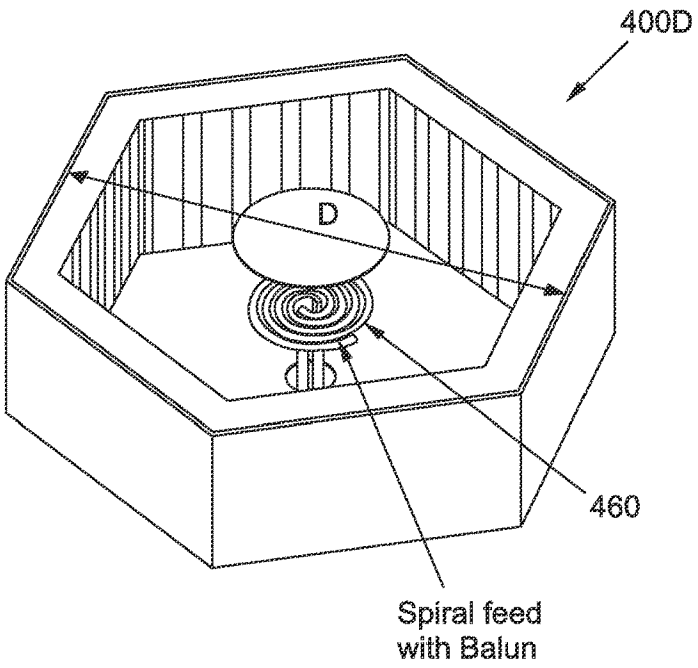
Figure 4C:
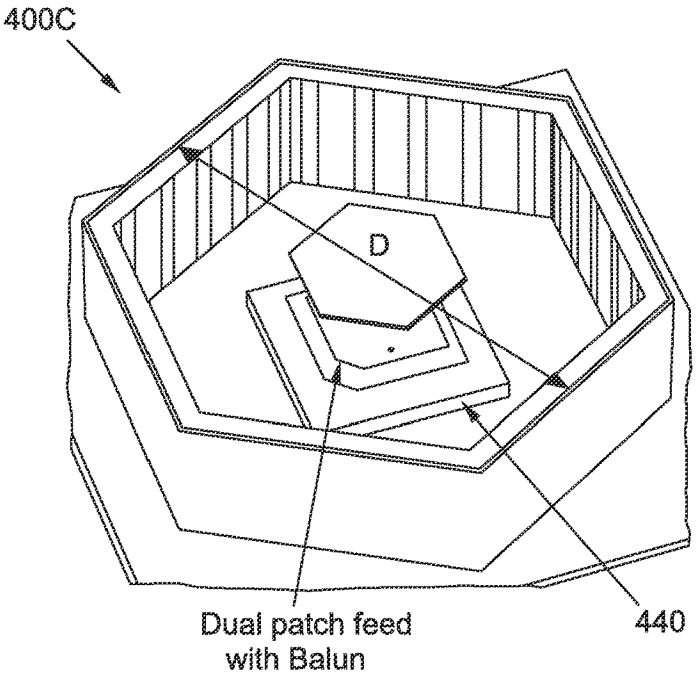

The high efficiency SPFA 400C shown in FIG. 4C employs a CP patch feed structure 450 using a dual stacked patch feed with balun. Alternatively, a high efficiency SPFA 400D, as shown in FIG. 4D, can use a spiral feed structure 460 with a balun. The patch feed 450 and the spiral feed 460 are circularly polarized feeds and can both be optimized for high power handling. The antenna can be optimized to operate, for example, at L1 and L2 GPS bands. Achievable aperture efficiency for the high efficiency SPFA 400C is over 90% in both L1 and L2 bands. A circular aperture offers even higher aperture efficiency than a hexagonal aperture.

Figure 4E:
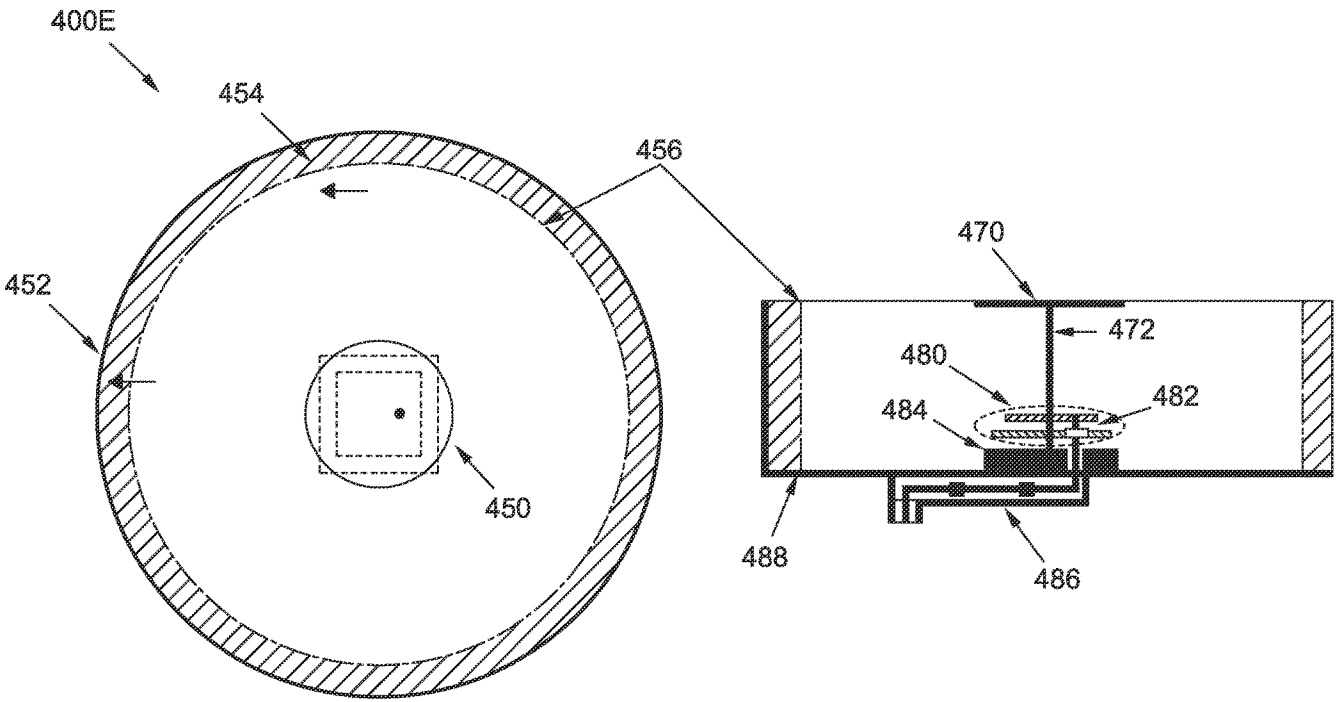

The high efficiency SPFA 400E shown in FIG. 4E employs the dual stacked patch feed structure 450. The reflector 452 and the liner dielectric 454 are similar to the SBFAs described above. The feed structure 450 includes the dual stacked microstrip CP patch (herein after "dual patch") 480 with a single feed probe, eliminating the need for a 90° hybrid to generate circular polarization. The feed passes through a metal pedestal 484, which together with a central rod 472 structurally supports the sub-reflector 470. The central rod 472 also allows for electro-static discharge (ESD) bleed-off for the sub-reflector 470 and for the dual patch 480, and also acts as a mode suppressor.

Figure 5A:
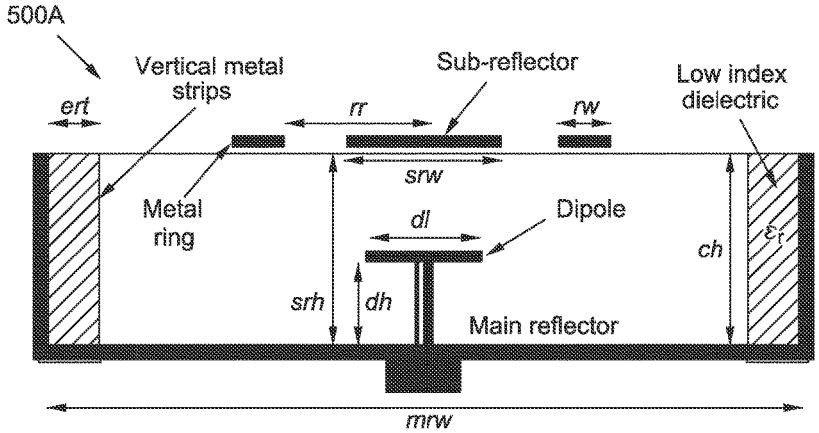
FIGS. 5A through 5E are diagrams illustrating an example of a SBFA with a dipole-feed structure and corresponding simulated performance results, according to certain aspects.
Figure 5B:
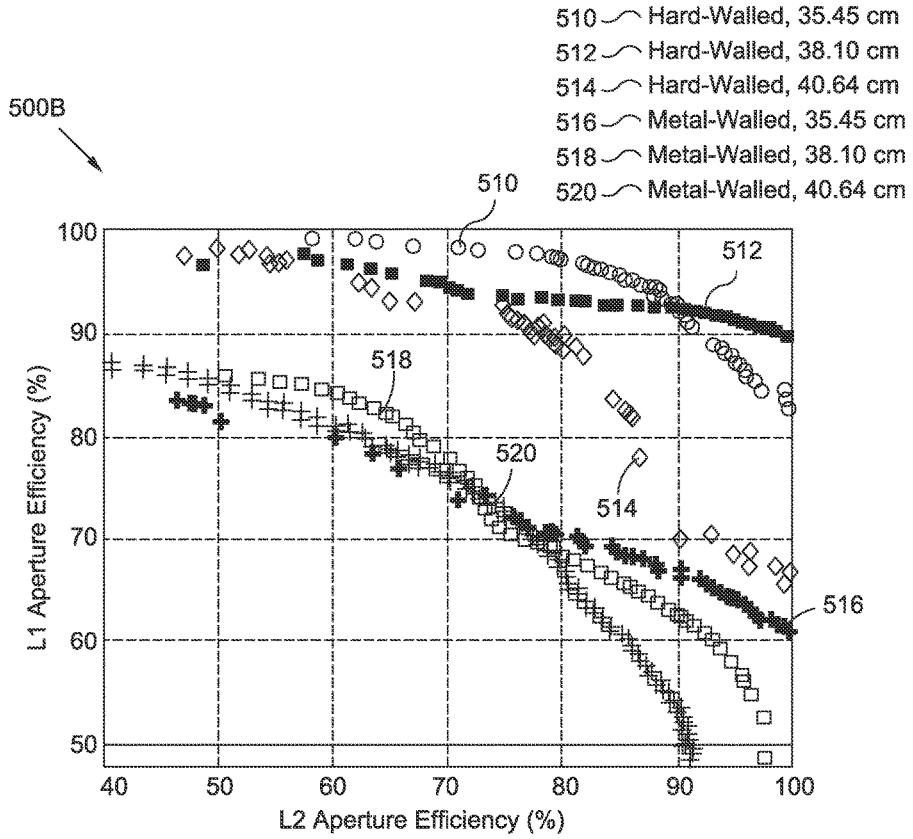
Figure 5C:
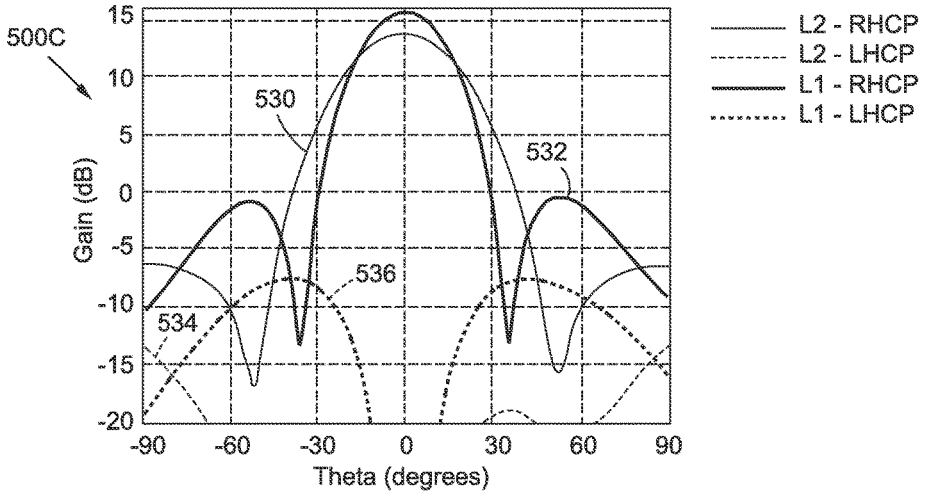
Figure 5D:
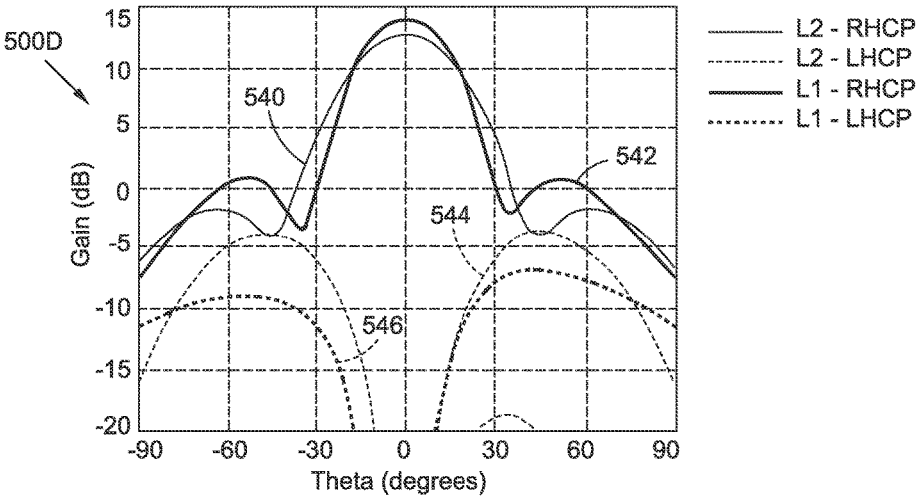
Figure 5E:
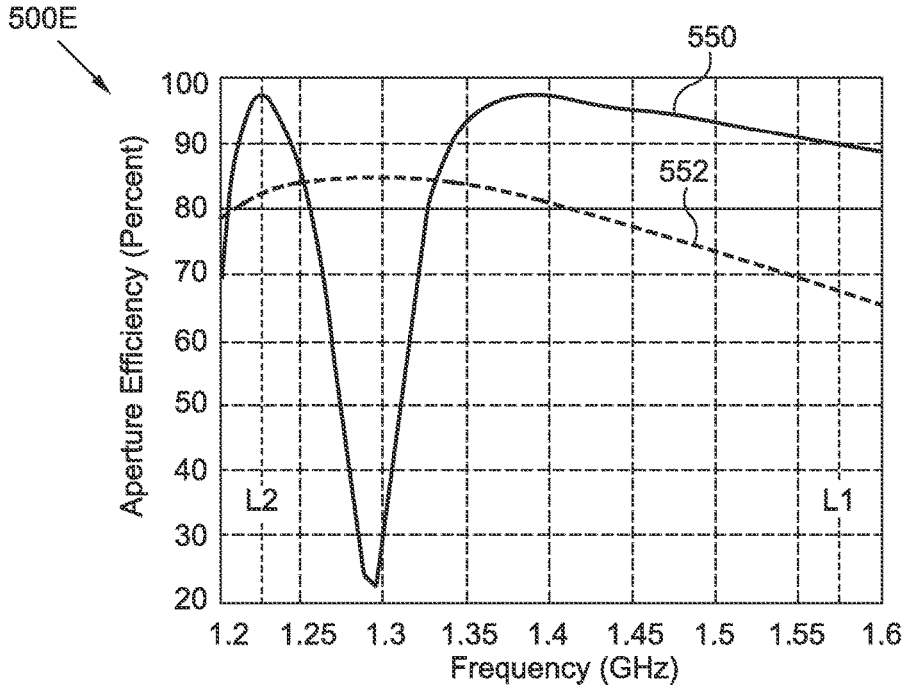

FIGS. 5A through 5E are diagrams illustrating an example of a SBFA with a dipole-feed structure 500A and corresponding simulated performance results 500B through 500E, according to certain aspects of the subject technology. The SBFA 500A of FIG. 5A, which in addition to a sub-reflector, has a circular ring with an inner diameter rr and width rw, is optimized with the primary metric being the aperture efficiency at efficiencies corresponding to L1 and L2 bands. The SBFA 500A can also be optimized for minimum weight and height. The hard-walled SBFA can be optimized for several (e.g., three) different aperture diameters mrw, for example, 35.45 cm, 38.10 cm, and 40.64 cm. The optimization of the hard-walled SBFA may use a number of (e.g., seven) optimization variables including dh, srh, ch, srw, rr, rw, ert, as shown in FIG. 5A. The height of the cavity (ch) may be constrained between 0.2 and $0.52\lambda_{L2}$. The height of the dipole (dh) may be constrained between 0.15 and $0.4\lambda_{L2}$. The height of the sub-reflector (srh) is constrained between dh+$0.1\lambda_{L2}$ and dh+$1.0\lambda_{L2}$. The variables srw, rr, and rw may be constrained so that there would be no spatial interference between the ring and sub-reflector and with the main reflector wall. Additionally, if rw is less than $\lambda_{L2}/100$, the ring around the sub-reflector may be removed in the simulation. The thickness of the foam wall (e.g., with low index dielectric) can be constrained between $0.2\lambda_{L2}/4t$ and $1.2\lambda_{L2}/4t$, where $\lambda_{L2}/4t$ ($t=(\varepsilon_r 1)^{1/2}$) is the asymptotic hard surface value at L2 for large apertures. To keep the weight down, $\varepsilon_r$ is kept low for minimum specific density, but not too close to unity to keep the wall thickness reasonably small to operate as the hard surface.

The simulated performance results 500B includes plots 510, 512, 514, 516, 518, and 520 of L1 aperture efficiency (%) versus L2 aperture efficiency (%) for three different diameters (mrw) of hard walled (including metal strips) and metal-walled (conventional) SBFAs, as shown in the legends of the diagram.

The simulated performance results 500C include plots of circularly polarized patterns showing directivity versus frequency plots 530, 532, 534, and 536 for a high efficiency SBFA of the subject technology. The plots 530 and 532 correspond to L2 and L1 right-hand circular polarization (RHCP), respectively, and plots 534 and 536 correspond to L2 and L1 left-hand circular polarization (LHCP), respectively.

The simulated performance results 500D include plots of circularly polarized pattern showing directivity versus frequency plots 540, 542, 544, and 546 for a conventional SBFA. The plots 540 and 542 correspond to L2 and L1

RHCP, respectively, and plots 544 and 546 correspond to L2 and L1 left-hand circular polarization (LHCP), respectively. A comparison between the plots in 500C and 500D shows a significant improvement in directivity and cross-polarization for the subject high efficiency SBFA over the conventional SBFA.

The simulated performance results 500E include aperture efficiency versus frequency plots 550 and 552 for a high efficiency SBFA of the subject technology and a conventional SBFA, respectively. Both SBFAs were optimized for a high directivity at L1 and L2 bands. The substantially higher performance of the high efficiency SBFA of the subject technology as compared to the conventional SBFA is clear from the above discussed simulation results.

Figure 6:
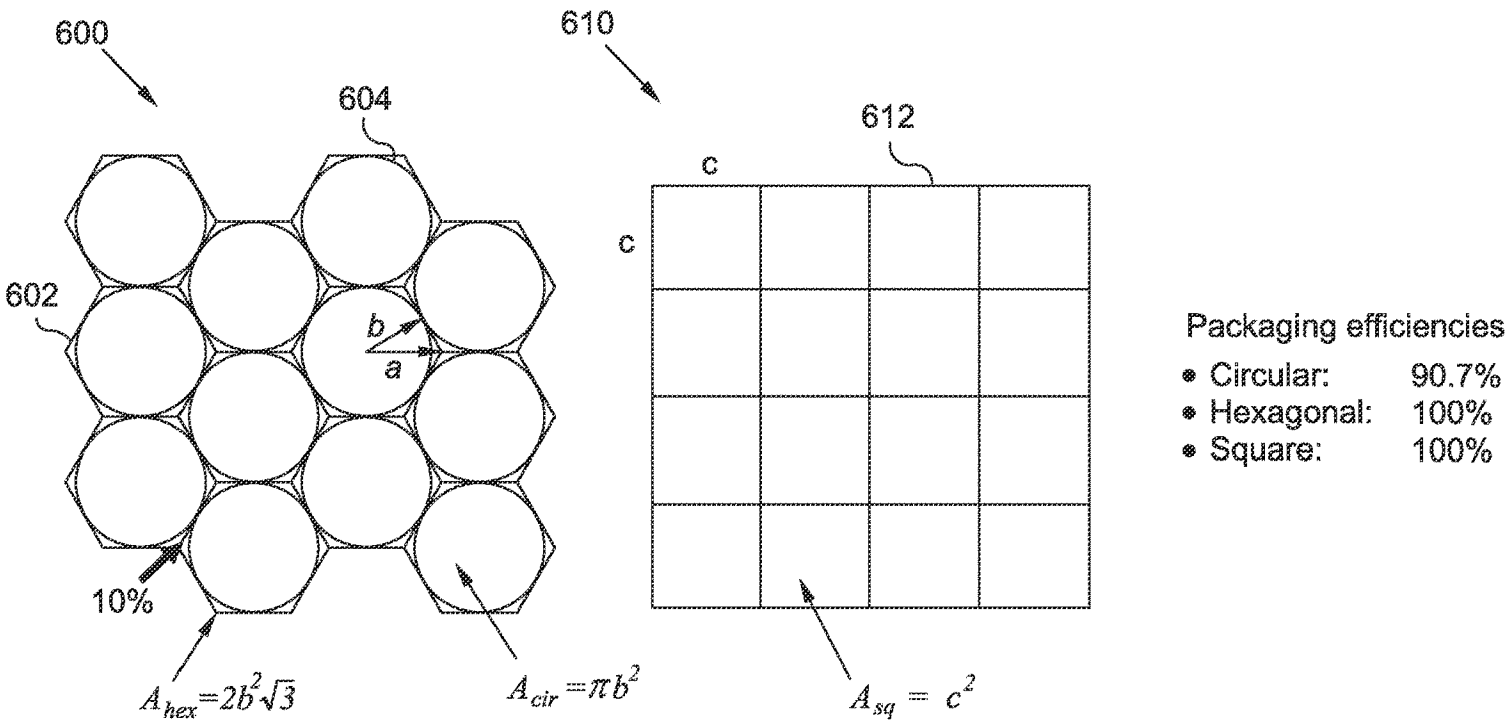
FIG. 6 is a diagram illustrating examples of arrays of SBFA, according to certain aspects of the subject technology.

FIG. 6 is a diagram illustrating examples of arrays 600 and 610 of SBFA, according to certain aspects of the subject technology. In one or more implementations, the high efficiency SBFA of the subject technology may be employed in a variety of array shapes and array configurations. Examples of shapes of the SBFA, as shown above, are circular, square, or hexagonal. The SBFAs of any shape can be employed in an array such as arrays 600 and 610 of FIG. 6. The array 600 can be implemented with circular elements 604 or hexagonal elements 602. However, the array packaging efficiencies are different. For example, with circular elements 604, the packing efficiency is ~91%, whereas with the hexagonal elements 602, 100% packing efficiency is achievable. Similarly, with square elements 612, an array 610 with 100% packing efficiency can be achieved. For a circular element (e.g., 604) with a radius b, the area is given as $b\pi^2$, and for a corresponding equivalent hexagonal element (e.g., 602) the area is $2b^2\sqrt{3}$. For the hexagonal array 600 to have approximately the same average scan loss as the square array 610, a side c of each square element 612 of the array 610 is given as: $c=b\sqrt{2\sqrt{3}}$.

Figure 7A:
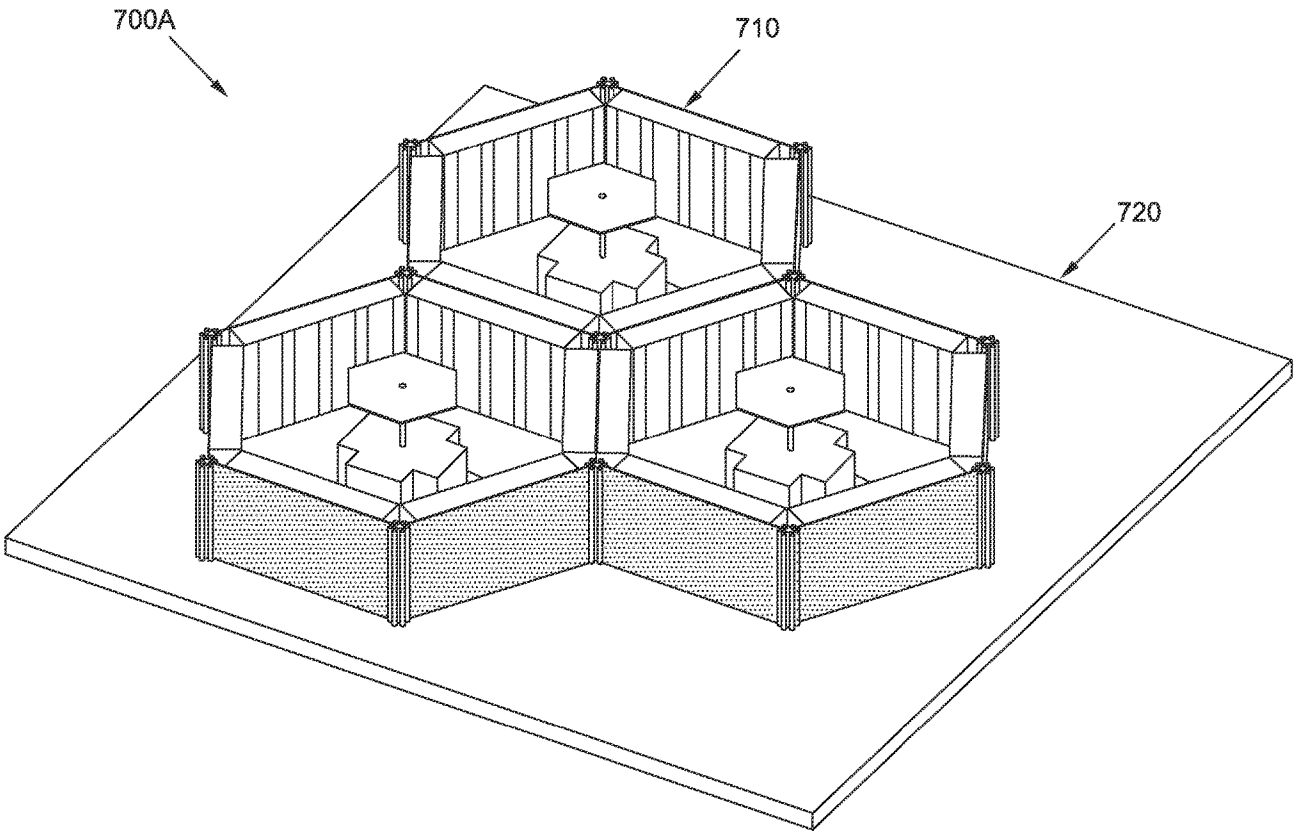
FIGS. 7A through 7C are diagrams illustrating an example of a hexagonal SBFA array, according to certain aspects of the subject technology.
Figure 7B:
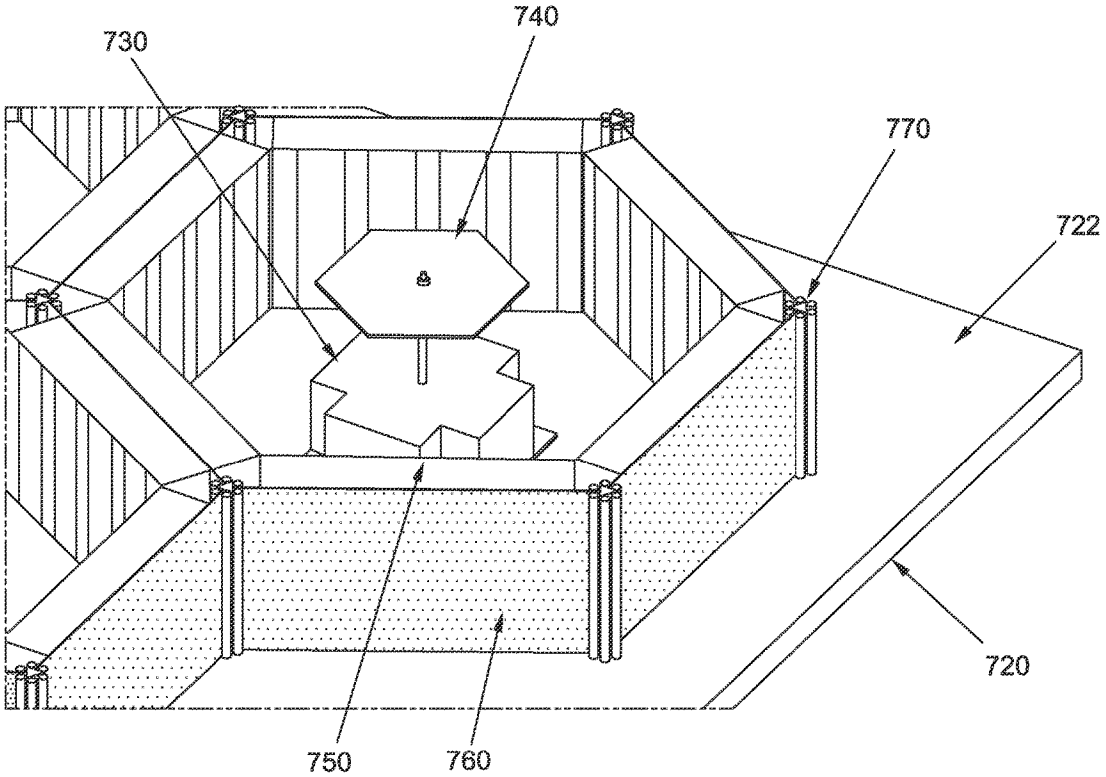
Figure 7C:
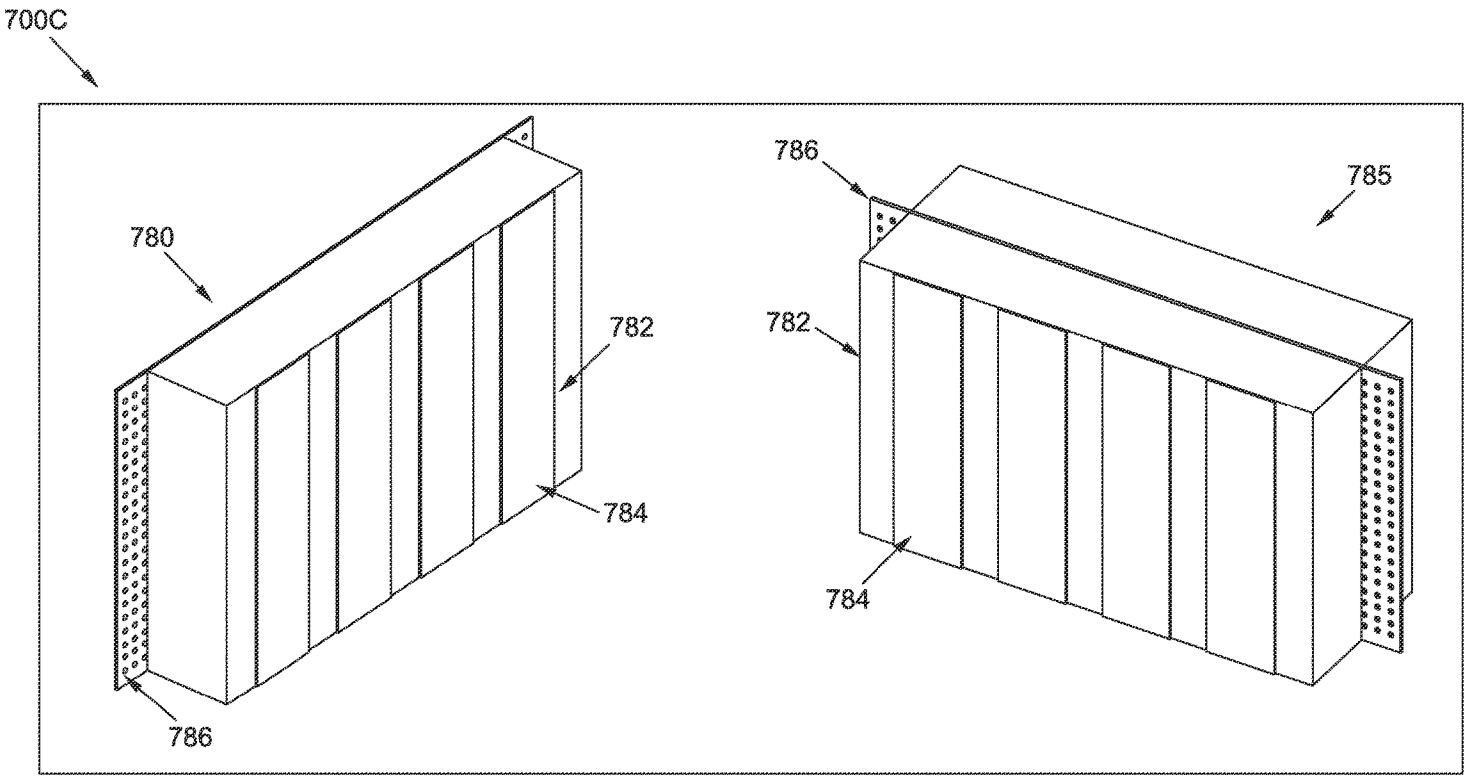

FIGS. 7A through 7C are diagrams illustrating an example of a hexagonal SBFA array 700A according to certain aspects of the subject technology. The hexagonal SBFA array 700A includes a number of hexagonal SFBA elements 710 assembled over a honeycomb structural panel 720, which includes a conductive face-sheet 722 and serves as the common ground plane of the hexagonal SBFA array 700A. The honeycomb structural panel 720 offers reduced assembly cost and excellent heat spreading. A more detailed structure of each element of the hexagonal SBFA array 700A is shown in FIG. 7B. As shown in FIG. 7B, each element of the hexagonal SBFA array 700A includes a feed structure including a patch element assembly 730 and a perforated sub-reflector 740 for reduced weight. The side walls of the hexagonal element are joined with corner post structures 770, which include card guides that facilitate assembly of the hexagonal element and reduce assembly cost. Each side wall includes a dielectric wall 750 and perforated metal wall 760, which offers reduced weight.

In some implementations, the side walls of the hexagonal element, as shown in FIG. 7C, may be formed as one of a single sided wall 780 or double-sided wall 785. The single sided wall includes a perforated metal wall 786, a dielectric foam 782 on one side of the perforated metal wall 786, and a polyamide flex circuit 784 designed to provide a hard surface, implemented with strip loading or metamaterial. The double-sided wall 785 comprises the perforated metal wall 786, the dielectric foam 782 on both sides of a common perforated metal wall 786, and the polyamide flex circuit 784 covering the dielectric foam 782 from an inside of the hexagonal element 710. The wall is an anisotropic impedance boundary and the double-sided wall 785 offers reduced weight and recurring cost.

Figure 8:
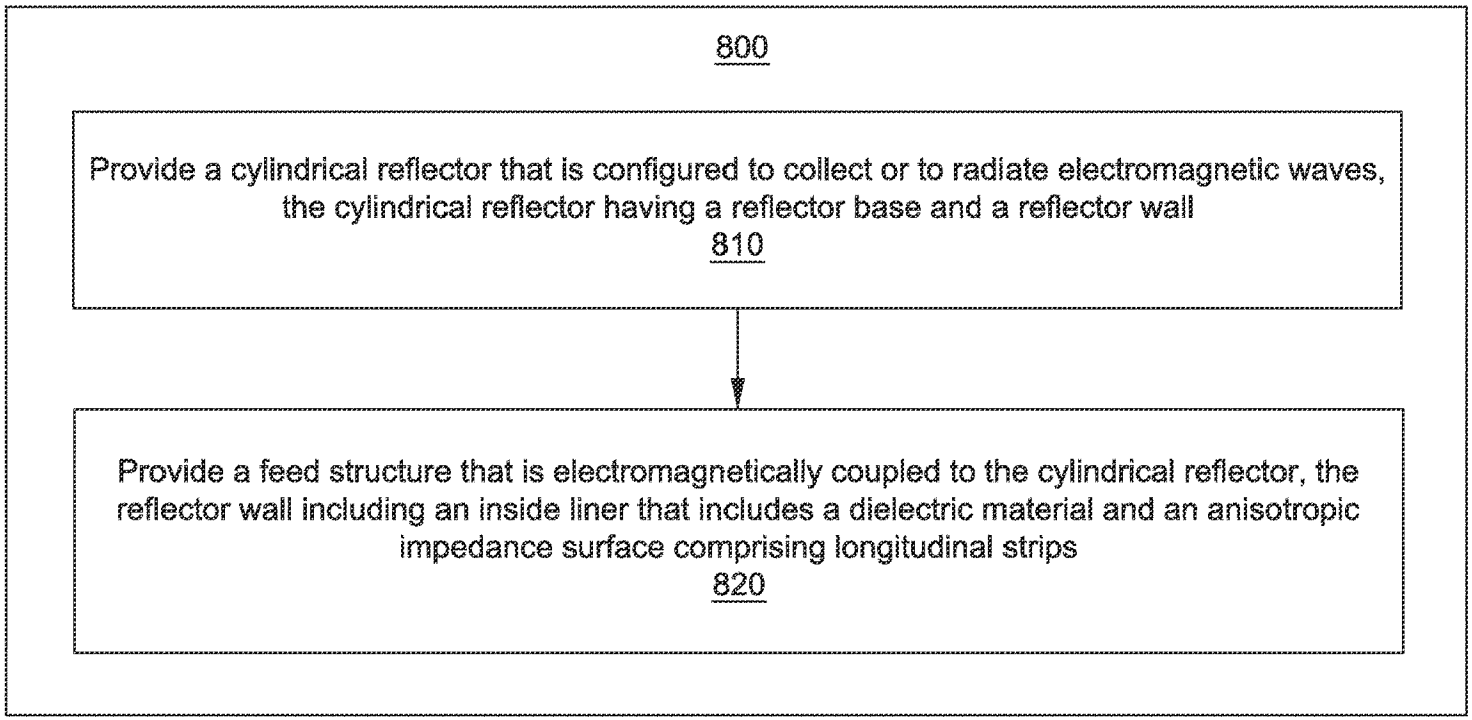
FIG. 8 is a flow diagram illustrating an example of a method for providing a high efficiency SBFA, according to certain aspects.

FIG. 8 is a flow diagram illustrating an example of a method 800 for providing a high efficiency SBFA, according to certain aspects of the subject technology. According to the method 800, a cylindrical reflector (e.g., 135 of FIG. 1) and a feed structure (e.g., any of 132, 134, or 136 of FIG. 1, 440 of FIG. 4C or 460 of FIG. 4D) are provided (810). The cylindrical reflector is configured to collect or to radiate electromagnetic waves, and includes a reflector base (e.g., 124 of FIG. 1) and a reflector wall (e.g., 122 of FIG. 1) (820). The feed structure is electromagnetically coupled to the cylindrical reflector. The reflector wall includes an inside liner (e.g., 144 of FIG. 1). The inside liner includes a dielectric material (e.g., 320 of FIG. 3B) and includes an anisotropic impedance surface or a hard surface (e.g., 322 of FIG. 3B) comprising longitudinal strips. Alternatively, the inside surface may be a metamaterial structure.

The description of the subject technology is provided to enable any person skilled in the art to practice the various aspects described herein. While the subject technology has been particularly described with reference to the various figures and aspects, it should be understood that these are for illustration purposes only and should not be taken as limiting the scope of the subject technology.

A reference to an element in the singular is not intended to mean "one and only one" unless specifically stated, but rather "one or more." The term "some" refers to one or more. Underlined and/or italicized headings and subheadings are used for convenience only, do not limit the subject technology, and are not referred to in connection with the interpretation of the description of the subject technology. All structural and functional equivalents to the elements of the various aspects described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

Although the invention has been described with reference to the disclosed aspects, one having ordinary skill in the art will readily appreciate that these aspects are only illustrative of the invention. It should be understood that various modifications can be made without departing from the spirit of the invention. The particular aspects disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative aspects disclosed above may be altered, combined, or modified and all such variations are considered within the scope and spirit of the present invention. While compositions and methods are described in terms of "comprising," "containing," or "including" various components or steps, the compositions and methods can also "consist essentially of" or "consist of" the various components and operations. All numbers and ranges disclosed above can vary by some amount. Whenever a numerical range with a lower limit and an upper limit is disclosed, any number and any subrange falling within the broader range are specifically disclosed. Also, the terms in the claims have their plain, ordinary meaning unless otherwise explicitly and clearly defined by the patentee. If there is any conflict in the usages of a word or term in this specification and one or more patent or other documents that may be incorporated herein by reference, the definitions that are consistent with this specification should be adopted.

What is claimed is:

1. A high efficiency short backfire antenna (SBFA), the antenna comprising:

a conductive cylindrical reflector configured to collect or to radiate electromagnetic waves, the cylindrical reflector having a reflector base and a reflector wall; and a feed structure electromagnetically coupled to the cylindrical reflector, wherein:

the cylindrical reflector is a hollow cylinder, the feed structure comprises a hexagonal patch element assembly and a perforated hexagonal sub-reflector, the reflector base is formed in a hexagonal shape, the reflector wall includes a dielectric liner formed on an inside surface of the cylindrical reflector, and the dielectric liner is covered with a structured anisotropic impedance surface.

2. The antenna of claim 1, wherein the anisotropic impedance surface comprises an electromagnetically (EM) hard surface, wherein the dielectric liner comprises an artificial dielectric, and wherein the artificial dielectric comprises a honeycomb structure.

3. The antenna of claim 1, wherein a value for a diameter of the reflector base is within the range of approximately 1.8 to 2.2 wavelength (λ) of the electromagnetic waves.

4. The antenna of claim 3, wherein a value for a height of the reflector wall is within the range of 0.25 to 1.5λ of the electromagnetic waves.

5. The antenna of claim 1, wherein the structured anisotropic impedance surface comprises one of a corrugated, a strip-loaded, or a metamaterial surface, wherein the strip-loaded surface comprises longitudinal strips of an electrically conductive material, wherein the electrically conductive material comprises a metal, wherein the longitudinal strips are tapered.

6. The antenna of claim 5, wherein the longitudinal strips comprise rotationally symmetric longitudinal strips, wherein the longitudinal strips have a uniform width value and a uniform spacing value, wherein the uniform spacing value is larger or equal to the uniform width value.

7. The antenna of claim 1, wherein the antenna further comprises a 90° hybrid configured to convert the field between linear and circular polarization.

8. The antenna of claim 1, wherein the patch feed comprises a dual patch feed with a balun, and wherein the dual patch feed is optimized for high power handling.

9. A method for providing a high efficiency short backfire antenna (SBFA), the method comprising:

providing a conductive cylindrical reflector that is configured to collect or to radiate electromagnetic waves, the cylindrical reflector having a reflector base and a reflector wall; and providing a feed structure that is electromagnetically coupled to the cylindrical reflector, wherein:

the cylindrical reflector is a hollow cylinder, the feed structure comprises a hexagonal patch element assembly and a perforated hexagonal sub-reflector, the reflector base is formed in a hexagonal shape, the reflector wall includes an inside liner, and the inside liner comprises a dielectric material and includes an anisotropic impedance surface comprising longitudinal strips.

10. The method of claim 9, wherein providing the anisotropic impedance surface comprises providing an electromagnetically (EM) hard surface, wherein the dielectric liner comprises an artificial dielectric, and wherein the artificial dielectric comprises a honeycomb structure.

11. The method of claim 9, wherein the method further comprises allowing a diameter of the reflector base vary within the range of approximately 1.8 to 2.2 wavelength (λ) of the electromagnetic waves.

12. The method of claim 11, further comprising allowing a height of the reflector wall vary within the range of 0.25 to 1.5λ of the electromagnetic waves.

13. The method of claim 9, wherein the anisotropic impedance surface comprises an electromagnetically (EM) hard surface including longitudinal strips of an electrically conductive material that are formed on the inside liner, wherein the electrically conductive material comprises a metal, wherein the longitudinal strips are tapered.

14. The method of claim 9, wherein the longitudinal strips comprise rotationally symmetric longitudinal strips, and wherein the method further comprises allowing a width of each longitudinal strip vary and a distance between two adjacent longitudinal strips vary while keeping approximately uniform widths and distances across all longitudinal strips, wherein metrics of the performance of the SBFA include an aperture efficiency of the SBFA.

15. The method of claim 9, further comprising providing a 90 hybrid configured to convert the field between linear and circular polarization.

16. The antenna of claim 9, wherein the patch feed comprises a dual patch feed with a balun, and wherein the dual patch feed is optimized for high power handling.

17. An antenna array comprising:

a plurality of high efficiency short backfire antenna (SBFA) elements, each SBFA element comprising:

a conductive cylindrical reflector comprising a reflector base and a reflector wall and configured to collect or to radiate electromagnetic waves; and a feed structure electromagnetically coupled to the cylindrical reflector and configured to convert collected electromagnetic waves to an induced electrical current or to convert a feed electrical current to electromagnetic waves for transmission by the SBFA, wherein:

the feed structure comprises a hexagonal patch element assembly and a perforated hexagonal sub-reflector, the cylindrical reflector is a hollow cylinder, the reflector base is formed in a hexagonal shape, the reflector wall includes a dielectric liner formed on an inside surface of the cylindrical reflector, and the dielectric liner is covered with an anisotropic impedance surface.

18. The antenna array of claim 17, wherein:

the reflector base is formed in one of a circular, a hexagonal, a square, or a multi-section shape, the dielectric material comprises foam material, the anisotropic impedance surface comprises an electromagnetically (EM) hard surface including longitudinal strips of an electrically conductive material, the anisotropic impedance surface comprises a metamaterial, the electrically conductive material comprises a metal, the longitudinal strips are tapered, the longitudinal strips comprise rotationally symmetric longitudinal strips, and the SBFA elements further comprises one of a dipole, a spiral, or a patch feed structure.

19. The antenna array of claim 17, wherein:

each SBFA element comprises a hexagonal element, the plurality of SBFA elements are assembled on a honeycomb structural panel configured to serve as a common ground for the antenna array, the plurality of SBFA elements comprise SBFA walls that are configured to be joined by corner posts including card guides, each SBFA wall comprises at least one of a single sided or double-sided wall, the single sided wall comprises a perforated metal wall, a dielectric foam on one side of the perforated metal wall, and a polyamide flex circuit forming the anisotropic impedance surface, the double-sided wall comprises the perforated metal wall, the dielectric foam on both sides of the perforated metal wall, and the polyamide flex circuit covering the dielectric foam from an inside of the hexagonal element.

* * * * *